United States Patent [19]

Ethell

[11] Patent Number: 4,741,187

[45] Date of Patent: May 3, 1988

[54] CAP LOCKING SHIELD FOR PORTABLE FUEL TANKS

[76] Inventor: Keith E. Ethell, 1943 Drendel Cir., Paradise, Calif. 95969

[21] Appl. No.: 117,331

[22] Filed: Nov. 6, 1987

[51] Int. Cl.[4] ..... B65D 55/14

[52] U.S. Cl. ..... 70/158; 70/232

[58] Field of Search ..... 70/14, 57, 58, 158, 70/159, 160, 161, 162, 163, 164, 165, 166, 167, 168, 169, 170, 171, 172, 173, 229, 232

[56] References Cited

U.S. PATENT DOCUMENTS 1,051,014 1/1913 Ryan ..... 70/158

1,825,726 10/1931 Gredell ..... 70/164

4,313,321 2/1982 Wasser ..... 70/232

*Primary Examiner*—Robert L. Wolfe

[57] ABSTRACT

A locking shield is provided for covering the fuel cap of particular portable fuel tanks. A tapered flat sheet shield base is structured with a widened end extended, angled, and aperture to be retainably fitted to a fuel tank handle tab adjacent the fuel filler neck. The shield base has flanged sides and is positioned horizontally with the sides and angled end downwardly to cover the fuel filler neck and fuel cap. Extensions of the flanged sides at the narrow end of the shield base are apertured and arranged to position so the device can be padlocked inside the loop of a closed loop handle on the top of the portable fuel tank.

4 Claims, 1 Drawing Sheet

CAP LOCKING SHIELD FOR PORTABLE FUEL TANKS

BACKGROUND OF THE INVENTION

1. Field of the Invention

This invention relates to locking devices which fit over fuel tank caps preventing the caps from being removed and the fuel being tampered with or stolen. The present invention is particularly directed towards a cap locking system for small portable fuel tanks used on crafts such as small fishing or recreational boats.

2. Description of the Prior Art

Past art patents were examined from a search conducted in the following classes and subclasses:

70/164, 163, 158

The following patents were noted as being most pertinent to my invention:

A patent issued to Levey on Oct. 14, 1930, U.S. Pat. No. 1,778,502, shows an automobile gas cap lock designed to prevent theft of the auto.

U.S. Pat. No. 2,265,438, issued to Marple, dated Dec. 9, 1941, shows a locking switch cover.

A patent issued to Dawkins, dated July 1, 1958, U.S. Pat. No. 2,841,658, teaches a locking device for dial telephones.

Horovitz received a patent dated Sept. 21, 1965, U.S. Pat. No. 3,206,955, which shows a bottle lock designed to keep unauthorized persons from the bottles contents.

A patent issued to Wasser, dated Feb. 2, 1982, shows a fuel tank locking means that requires the lock to bolted to the tank with bolts which extend through the tank wall. It is particulary designed for the fuel tank of large trucks.

U.S. Pat. No. 4,483,163, dated Nov. 20, 1984, issued to Carlyle shows a locking means for pressurized gas tanks such as the types used for oxygen and acetylene and other pressurized gases.

A patent issued to Gillette and Hillery, dated Jan. 24, 1984, U.S. Pat. No. 4,426,863, shows a tank cap locking means which require caps which are designed for each locking embodiment.

Jakubas received a patent dated Apr. 7, 1987, U.S. Pat. No. 4,655,060, which teaches a locking device for a drum which seals and locks the bung hole and vent hole of 35 and 55 gallon drums.

To my knowledge, the foregoing patents represented devices most pertinent to my invention. None of the aforementioned devices were as simple to install or for the same purpose as my device.

SUMMARY OF THE INVENTION

In practicing my invention, I have developed a lockable removable shield that covers and prevents the fuel cap from being opened on a particular design of three and six gallon portable fuel tank manufactured by Outboard Marine Corp. of Waukegan, IL. This tank is being extensively used in smaller crafts and houseboats.

Therefore, it is a primary object invention to provide a lockable and removable shield over the standard cap of this particular fuel tank without having to alter the tank or cap to prevent tampering with or theft of the fuel.

Another object of my invention is that the locking system uses conventional padlocks which can be purchased at most any hardware store.

A still further object of my invention is to provide an easily installed and removed locking system.

Other objects and the many advantages of my invention will become apparent from a consideration of the numbered parts list, drawings, and ensuring description of it.

BRIEF DESCRIPTION OF THE DRAWINGS

FIG. 2 B. shows a back view of the shield.

DRAWING REFERENCE NUMERALS

Figure 1:
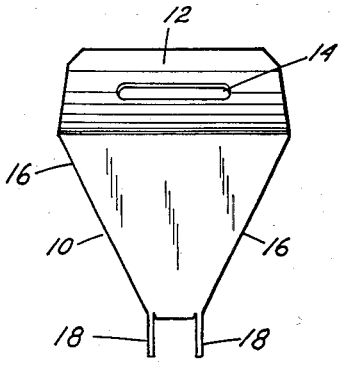
FIG. 1 shows a top plan view the cap lock shield in it's preferred embodiment.
Figure 2:
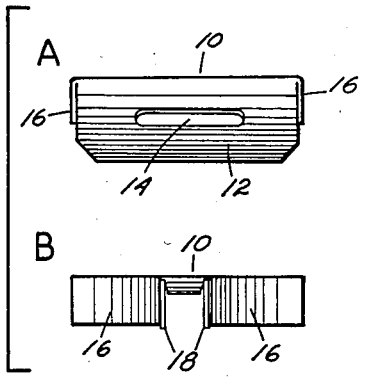
FIG. 2 A. shows a front view of cap lock shield.

10 shield base
12 angled base extension
14 tab handle aperture
16 side flanges
18 lock excepting arms
20 lock excepting apertures
22 bottom of shield base
24 fuel tank
26 tank fuel cap
28 tab handles
30 closed loop handle
32 fuel gage
34 padlock
36 lock shackle

DESCRIPTION OF THE PREFERRED EMBODIMENT

Figure 3:
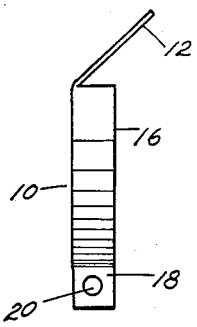
FIG. 3. shows a side view of the shield.

Referring now to the drawings at FIG. 1 where the preferred embodiment of my invention is illustrated in a top plan view. Shield base 10 consisting of a thin flat sheet having a narrow end tapering outwardly to a wide end to which is attached front extension 12 angled downwardly and containing tab handle aperture 14 sized to except tab handle 28 ( FIG. 6). Also attached to shield base 10 are two side flanges 16 extending from the wide end through the narrow end of base shield 10 being angled downwardly at substantially 90 degrees and extending past the shield base 10 to form lock excepting arms 18 which have lock excepting apertures 20 ( FIG. 3).

Figure 4:
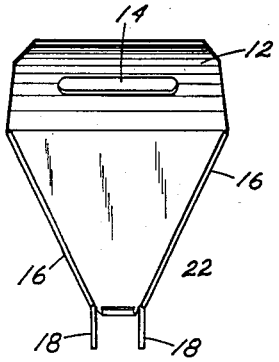
FIG. 4. shows a bottom view of the shield.
Figure 5:
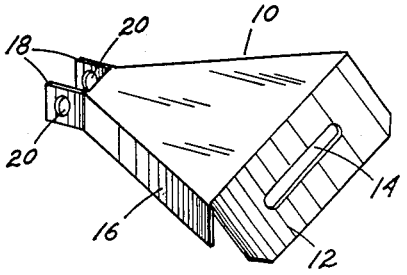
FIG. 5. shows a perspective view of the shield.

FIGS. 2, 3, 4, 5, show the relative positions of the aforementioned parts and the bottom of base shield 22 ( FIG. 4)

Figure 6:
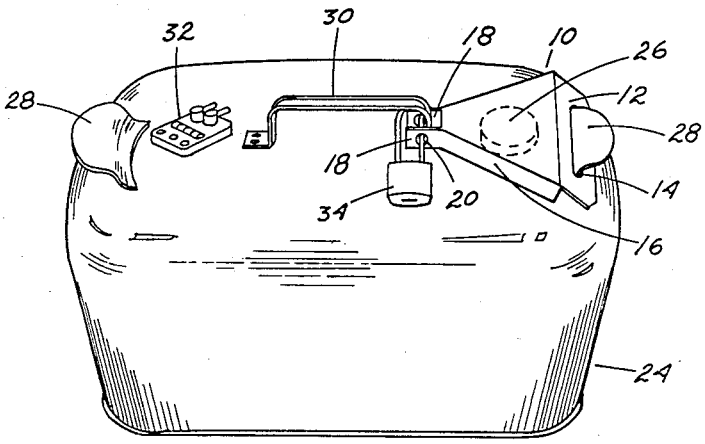
FIG. 6. shows the fuel tank with its two handle systems for carrying the tank. The closed loop handle in the center of the tank and the two tab handles on opposing ends of the tank. Also shown is the shield in place over the fuel cap with a tab handle of the fuel tank protruding through an aperture in the front end of the shield and the back end of the shield locked to the closed loop handle of the fuel tank by a standard padlock.

FIG. 6 illustrates a fuel tank 24 having a fuel gage 32, a set of tab handles 28 on opposing ends of fuel tank 24, a single closed loop handle 30, and a tank fuel cap 26 which all of which comprise the tank. Also illustrated is the preferred embodiment of my invention in the position of its intended use having the tab handle 28 nearest the tank fuel cap positioned through tab handle aperture 14 with angled base extension 12 angling downwardly toward the fuel tank 24 forming in conjunction with side flanges 16 a recessed cavity to which tank fuel cap 26 is located and secured from removal when lock excepting arms 18 are positioned forward and on either side of closed loop handle 30 allowing lock shackle 36 of padlock 34 to be positioned through lock excepting apertures 20 on the inside of closed loop handle 30 keeping unauthorized persons from being able to remove tank fuel cap 26.

The above described embodiment is made of metal and can be made of semi-ridged or ridged plastic of sufficient strength and rigidity to adequately detour thieves who don't have on hand the proper tools to defeat the locking system.

Although I have described the preferred embodiment of my invention with considerable details in the specification, it is to be understood that I may practice modifications in the structure and design of the invention device so long as any changes made remain within the intended scope of the appended claims.

I claims:

1. A locking shield for covering the fuel cap of particular portable fuel tanks which are manufactured with a centrally positioned closed loop handle in the top surface and have tab handles longitudinally aligned horizontally with said closed loop handle manufactured in said top surface adjacent either end of said portable fuel tanks and said portable fuel tanks having a low profile fuel filler neck with a removable cap thereon in said top surface between one of said handle tab and said centrally positioned closed loop handle;

said locking shield consisting of a thin flat sheet shield base sized and arranged for horizontal placement over said cap on said fuel filler neck with said shield base having a narrowed end and sides tapering outwardly to a widened end terminating downwardly in an angled base extension sufficiently lengthened and apertured to fit retained to said handle tab adjacent said fuel filler neck covering said cap thereon, there being downwardly angled side flanges along said tapering sides of said shield base with apertured extensions at said narrowed end of said shield base, said side flange extensions of sufficient length to removably attach a padlock shackle through said apertures in said side extension to position a locking padlock in the loop of said closed loop handle and secure said shield base and said side flanges downwardly covering said fuel filler neck and the cap thereon.

2. The device of claim 1 wherein said locking shield is fabricated of metal.

3. The device of claim 1 wherein said locking shield is fabricated of composite materials including semi-ridged plastic and ridged plastic.

4. The device of claim 1 wherein said locking shield is varied in size and shape to accommodate a variety of fuel tanks manufactured and under development which conform cooperatively with said locking shield structure.

* * * * *